US005922131A

United States Patent [19]

Haas

[11] Patent Number: 5,922,131

[45] **Date of Patent: *Jul. 13, 1999**

[54] ELECTROSTATIC POWDER SPRAY COATING APPARATUS WITH ROTATING SPRAY ORIFICE

[75] Inventor: Gerald Haas, St. Gallen, Switzerland

[73] Assignee: Gema Volstatic AG, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/854,880

[22] Filed: May 12, 1997

[30] Foreign Application Priority Data

May 24, 1996 [DE] Germany ..... 196 21 072

[51] Int. Cl.[6] ..... B05B 5/025; B05C 5/02

[52] U.S. Cl. ..... 118/629; 118/620; 118/621; 118/624; 239/240; 239/252; 239/293; 239/105; 239/700

[58] Field of Search ..... 118/620, 621, 118/624, 629; 239/240, 252, 293, 105, 700

[56] References Cited

U.S. PATENT DOCUMENTS

| | | | |
|---|---|---|---|
| 3,004,517 | 10/1961 | Reindl | 118/627 |
| 3,120,346 | 2/1964 | Willhoite | 239/293 |
| 4,009,829 | 3/1977 | Sickles | 239/3 |
| 4,776,520 | 10/1988 | Merritt | 239/293 |
| 4,811,906 | 3/1989 | Prus | 239/700 |
| 4,887,770 | 12/1989 | Wacker et al. | 239/703 |
| 5,353,989 | 10/1994 | Drechsel | 239/252 |
| 5,368,237 | 11/1994 | Fulkerson | 239/706 |
| 5,397,063 | 3/1995 | Weinstein | 239/703 |
| 5,632,448 | 5/1997 | Alexander et al. | 239/703 |

FOREIGN PATENT DOCUMENTS

| | | | |
|---|---|---|---|
| 0 401 032 A1 | 12/1990 | European Pat. Off. . | |
| 422813 | 4/1991 | European Pat. Off. | 118/629 |
| 513626 | 11/1992 | European Pat. Off. . | |
| 576329 | 12/1993 | European Pat. Off. | 118/629 |
| 0 737 517 A2 | 10/1996 | European Pat. Off. . | |
| 1568143 | 5/1969 | France . | |
| 4005350 | 8/1991 | Germany . | |
| 4342339 | 6/1995 | Germany . | |
| 19608754 A1 | 9/1997 | Germany . | |
| 8-108106 | 4/1996 | Japan . | |
| 348087 | 9/1960 | Switzerland . | |
| 435052 | 10/1967 | Switzerland . | |
| 579951 | 9/1976 | Switzerland | 118/629 |
| WO 95/04604 | 2/1995 | WIPO . | |

OTHER PUBLICATIONS

Tipler, Paul., Physics for Scientists and Engineers, p. 677, 1991.

*Primary Examiner*—Peter Chin
*Assistant Examiner*—Michael P. Colaianni
*Attorney, Agent, or Firm*—MacMillan, Sobanski & Todd, LLC

[57] ABSTRACT

An electrostatic spray coating apparatus having a spray nozzle which has a spray orifice for atomizing coating material. The nozzle orifice may be round or, preferably, is in the form of a slot to impart a flat shape to the atomized material. The spray nozzle is mounted to be rotated on a body of the spray gun so that the atomized material particles are driven radially outwards in addition to the forward direction and are thereby distributed uniformly in the cloud of sprayed material. A brake may be provided to slow down the rotation when greater penetration into cavities in the article being painted is desired. In invention may be used in either power spray coating apparatus or liquid spray coating apparatus.

10 Claims, 3 Drawing Sheets

ELECTROSTATIC POWDER SPRAY COATING APPARATUS WITH ROTATING SPRAY ORIFICE

BACKGROUND OF THE INVENTION

The invention is directed to spray apparatus of the type which is generally described as electrostatic spray guns or as electrostatic spray coating guns. The electrostatic spray apparatus may be designed either for spraying on an article to be coated coating material in the form of a powder or coating material in the form of a liquid. The spray apparatus may be designed as hand held spray gun which includes a handle, or it may be designed as an automatic spray gun adapted to be supported by, for example, a stationary support, a reciprocator or an industrial robot. All of these options are included in the present invention.

An electrostatic spray gun according to the prior art is shown, for example, in U.S. Pat. No. 4,196,465. The spray gun serves to spray coating powder on an article. The spray gun has a barrel to which a handle can be attached or which may be mounted on a known carrier machine. A powder duct extends through the spray gun barrel from a rear end of the barrel to a spray nozzle on a front end of the barrel. The spray nozzle and the spray gun barrel are stationary relative to each other. The coating power is pneumatically fed by a compressed air flow and is atomized at the spray nozzle to form a powder cloud which flows onto the article to be coated. The spraying or atomization of the powder takes place at the spray nozzle through a nozzle effect and/or a diffuser effect.

One or more high voltage electrodes are disposed near the nozzle in the powder flow path. The electrodes are electrically connected to the high voltage output of a voltage generator. A high voltage applied to the electrodes may be in the range of between 1 KV and 170 KV for imparting an electrostatic charge to the sprayed powder relative to the article being coated. The voltage generator may be accommodated in the spray gun barrel. The voltage generator includes, for example, a converter or oscillator for converting a low voltage DC to AC, a transformer and a cascade circuit which are connected together. A low voltage input to the generator is adapted for connection to an external low voltage power source by means of a electric wire or cable. The low voltage may be DC or may be rectified from a low level AC voltage to form a DC low voltage. The oscillator converts this to an AC voltage which is stepped up to an intermediate voltage AC signal by the transformer. The cascade circuit then multiplies the intermediate level AC voltage to generate the desired high voltage. In accordance with a modified embodiment, the generator can be arranged outside of the spray gun and connected to the high voltage electrodes in the spray gun by way of a high voltage cable.

European patent application EP-A 0,513,626 teaches an electrostatic spray gun for spraying liquid coating material on an article in which the spraying or atomization of the coating liquid at the nozzle is aided by additional atomization air. If the coating liquid is fed to the nozzle at a relatively high pressure, the liquid can be atomized at the spray nozzle in the same manner as coating powder. The additional atomizing air is used to allow a reduction in the feed pressure of the coating liquid required for atomization. The atomizing air may be high pressure air with a low flow volume, or it may be low pressure air with a high flow volume, or it may be within an in between range. A high volume low pressure air flow in a spray gun is referred to as HVLP. To form a fan type spray stream of coating liquid, it is known to compress the atomized coating liquid envelope into a flatted fan shaped envelope by means of shaping air directed at opposite sides of the atomized liquid envelope. Coating liquid spray guns of this type may be provided with one or more high voltage electrodes to electrostatically charge the coating material relative to the article being coated. This results in a better coating quality and in a better coating efficiency since the electrostatic charge draws the coating particles towards the article being coated.

The art also teaches that for both coating powder and coating liquid, a fan shaped jet or envelope can be imparted to the sprayed material through the use of a nozzle with a discharge orifice having a slotted cross sectional shape.

The prior art such as U.S. Pat. No. 5,353,995 and European patent application EP-A 0,410,717 also teaches that the stationary spray nozzle as described above may be replaced with a rotating atomizer bell both in powder spray coating apparatus and in liquid spray coating apparatus. It has been demonstrated that a major advantage from using a rotary atomizer bell is that a more even coating thickness can be produced on flat surfaces. The coating thickness is more even due to the shape of the powder cloud emitted from the atomizer. The rotation of the atomizer bell generates a powder cloud having a relatively large diameter, for example, of 0.5 m, with homogeneous powder particle distribution.

The cloud of atomized powder has little forward velocity and is drawn to the article being coated through electrostatic attraction. The kinetic energy of the powder particles in the powder duct of the spray apparatus is distributed across the very much larger cross sectional area of the larger powder cloud. As a result, the powder particles receive less forward moving movement as they are atomized. This allows the particles to better follow the electric field lines extending from the high voltage electrode to the grounded electric conductor nearest the electrode, which is normally the closest points on the article being coated. As a consequence, the powder fails to penetrate and uniformly cover surfaces in cavities on the article being coated.

It is generally known that nozzles produce a forwardly directed fan jet have different coating characteristics from rotary atomizers. The film thickness distribution on the article being coated is frequently mediocre, whereas the penetration of the coating particles into cavities of the article being coated is very good. It would be desirable to produce a spray gun which creates the coating thickness uniformity of a rotary atomizer bell and which produces a spray which will penetrate cavities on the article being coated as with a stationary atomizer nozzle.

BRIEF SUMMARY OF THE INVENTION

The invention is directed to spray coating apparatus which utilizes both the advantage of uniform coating thickness across large surfaces and good penetration of the coating fluid particles in cavities of an article being coated in order to coat the interior surfaces in the cavities with both good quality and good efficiency. According to a preferred embodiment of the invention, a fan or slotted nozzle orifice is used to atomize the coating powder. During spraying, the nozzle is rotated at a relatively slow speed about an axis of rotation that extends along the longitudinal center axis of the nozzle. The low speed of rotation of the nozzle causes the coating material cloud to expand, but not to the extent that the forward movement of the atomized material is lost. The uniformity of the film thickness distribution on the article being coated is considerably better than that achieved with non rotating spray nozzles, since the rotary movement homogenizes the coating fluid cloud.

In place of a fan or slotted orifice, the rotating nozzle may be provided with a round orifice, or with a different shape. The invention is adaptable for use both in spray apparatus for powder coating materials and in spray apparatus for liquid coating materials. The orifice shape and size may be varied with the type of coating material. The speed of rotation of the spray nozzle can be fixed at a low rotational rate or controlled to provide the desired properties to the cloud of atomized material. The above described prior art features and operating modes including fan nozzle orifices, round nozzle orifices, the use of atomizing air, the use of pattern shaping air and the use of an electrostatic coating process may be used with the invention.

The objects and advantages of the invention will become apparent from the following detailed description of the invention and the accompanying drawings.

DETAILED DESCRIPTION OF THE INVENTION

Figure 1:
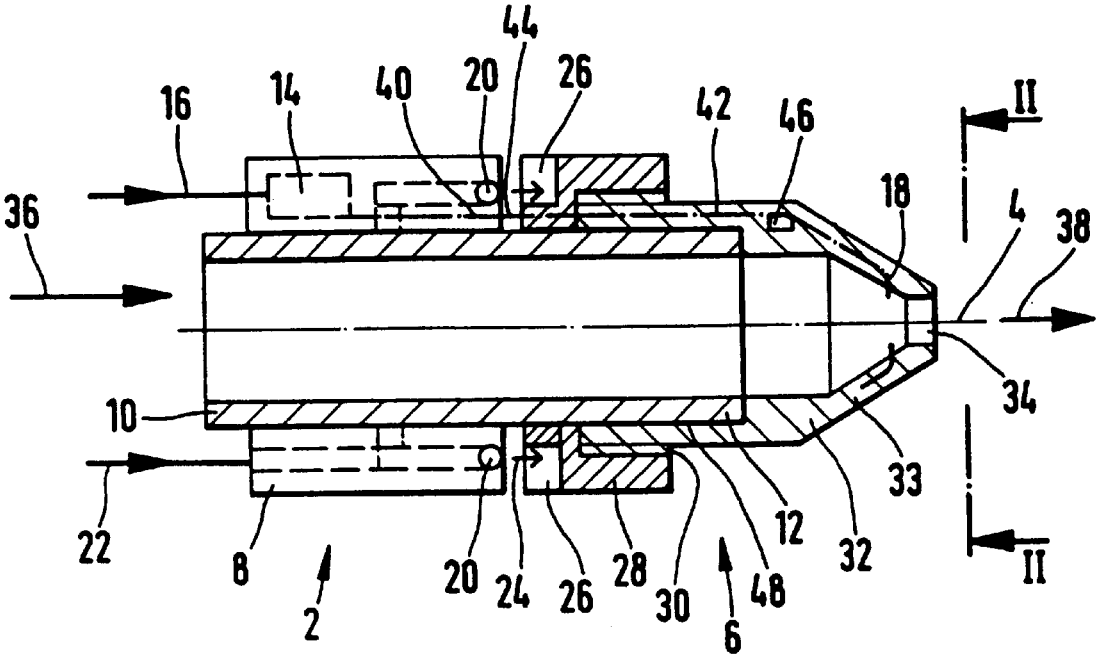
FIG. 1 schematically illustrates an axial cross sectional view through an electrostatic spray apparatus according to the invention for spray coating articles with coating liquid or with coating powder.
Figure 2:
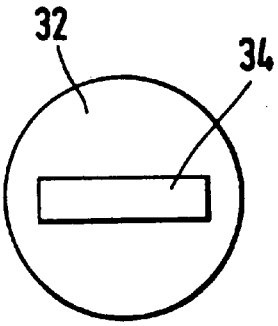
FIG. 2 is a front end view in the direction of the arrows II—II in FIG. I showing a rotary spray nozzle with a slot shaped orifice.

FIGS. 1 and 2 schematically illustrate spray coating apparatus according to one embodiment of the invention. The apparatus will be described for spray coating with a coating powder. However, it will be appreciated that the spray apparatus could be readily adapted for spray coating with a liquid coating material.

The spray apparatus has a non rotating main body assembly 2 and a nozzle assembly 6 which rotates about an axis of rotation 4 in relation to the main body assembly 2. The non rotating main body assembly 2 includes a ring-shaped housing 8 which extends coaxially to the axis of rotation 4. A tube 10 which forms a powder coating material feed duct extends through the housing 8 coaxial along the axis of rotation 4 and has an end section 12 which protrudes from a forward end of the housing 8. The tube 10 is fixed to the housing 8 so as to not rotate relative to the housing 8. The housing 8 contains a high voltage generator 14 which has a low voltage input electrically connected through a low voltage cable 16 to a low voltage power source (not shown). The high voltage generator 14 has a high voltage output connected to one or more high voltage electrodes 18. The electrodes 18 are located to electrostatically charge the coating powder. A high DC voltage applied by the generator 14 to the electrodes may range between 1 KV and 170 KV and preferably between about 20 KV and 100 KV.

The housing 8 also includes turbine compressed air nozzles 20 which are connected to a compressed air line 22 and direct compressed air 24 at turbine blades 26 on a turbine wheel 28. The compressed air flow causes the turbine wheel 28 to rotate relative to the housing 8 about the axis of rotation 4. The turbine wheel 28 is secured to a nozzle 32 with threads 30. At a downstream end, the nozzle 32 has a nozzle element 33 with a spray aperture or orifice 34 arranged on the axis of rotation 4. The spray aperture 34 preferably has a slotted shape as illustrated in FIG. 2. As shown, the spray aperture 34 is in the form of an elongated slot which extends perpendicular to the axis of rotation A. During operation of the spray apparatus, a powder flow 36 passes through the duct 10 and is discharged from the spray aperture 34 where it is atomized to form a cloud or envelope 38 having a flattened cross section. The atomized powder cloud proceeds onto an article (not shown) being coated. The turbine wheel 28 and the nozzle 32 form together a rotary assembly 6 and are mounted on the forwardly protruding section 12 of the duct or tube 10 by means of a bearing 48 so as to be rotatable about the axis of rotation 4. As a result of the rotation of the nozzle 32 and the aperture 34, the particles of the axial powder stream are entrained in eddy fashion about the axis of rotation 4. The powder particles in the cloud 38 are thereby driven outward in a direction radially to the axis of rotation 4 and thus are more evenly distributed within the powder cloud 38 than would be possible without rotation of the nozzle 32. However, the atomization of the coating powder is not adversely affected by the rotation. In a modified embodiment of the spray apparatus, the coating powder is atomized by a diffuser effect rather than by a nozzle effect. The rotation can aid the atomization.

One or more high voltage electrodes 18 are located in the nozzle 32 within or beside the flow path for the coating powder 36 and within or near the spray aperture 34. The electrodes 18 are located where they can electrostatically charge the coating powder flow 36. As is known in the art, the high voltage electrodes 18 may be swept by a separate flow of electrode air to prevent powder particles from clinging to the electrodes. The air flow also drives ions into the powder stream 36. As an alternative to the location for the electrodes 18 around the internal circumference of the nozzle 32 as shown in FIG. 1, it will be appreciated that a single electrode 18 may be located on the axis of rotation 4 adjacent the aperture 34, as is described below.

The high voltage path from the voltage generator 14 to the high voltage electrodes 18 consists of a non rotating electrical conductor 40 in the housing 8 and an electric conductor 42 which rotates with the turbine wheel 28 and the nozzle 32. The adjoining ends of the two conductors 40 and 42 are separated from each other by a narrow gap 44 between the housing 8 and the rotary assembly 6. The gap 44 is sufficiently small that the high voltage is able to jump across the gap 44 from the stationary conductor 40 to the rotating conductor 42, creating a non-contact electrical connection between the conductors 40 and 42. An electric resistor 46 may be arranged in the electric line path 40 or 42 for limiting the maximum electric current at the high voltage electrodes 18 in the event of a short circuit. Although the resistor 46 is illustrated in the path 42, it may optionally be located in the path 40.

Figure 3:
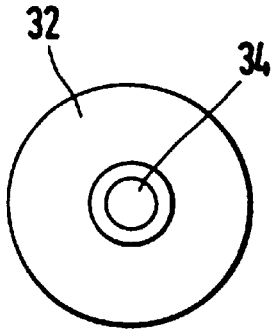
FIG. 3 is a front end view similar to FIG. 2, showing a spray nozzle with a nozzle orifice having a round cross section.

In the nozzle 32 shown in FIG. 2, the aperture or orifice 34 is in the form of a slot which flattens the atomized powder cloud as it is emitted from the aperture 34. The rotation of the nozzle 32 in turn causes the flat cloud to rotate and form a round cloud. FIG. 3 illustrates a front elevation of a modified embodiment of the nozzle 32 in which the nozzle aperture 34 has a round cross section.

Figure 4A:
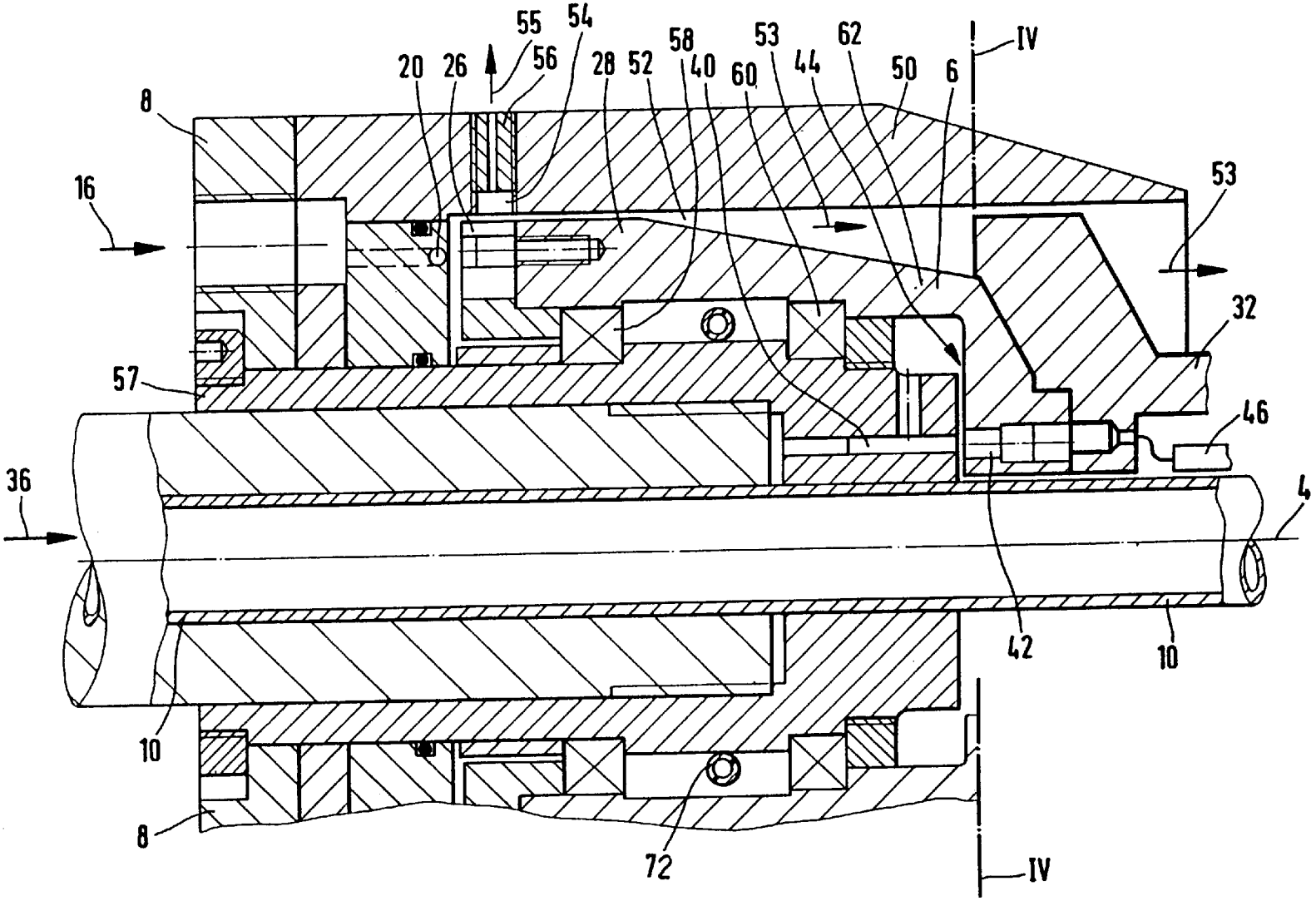
FIG. 4A is a fragmentary view in axial cross section of a rear portion of an electrostatic spray coating apparatus according to a further embodiment of the invention.
Figure 4B:
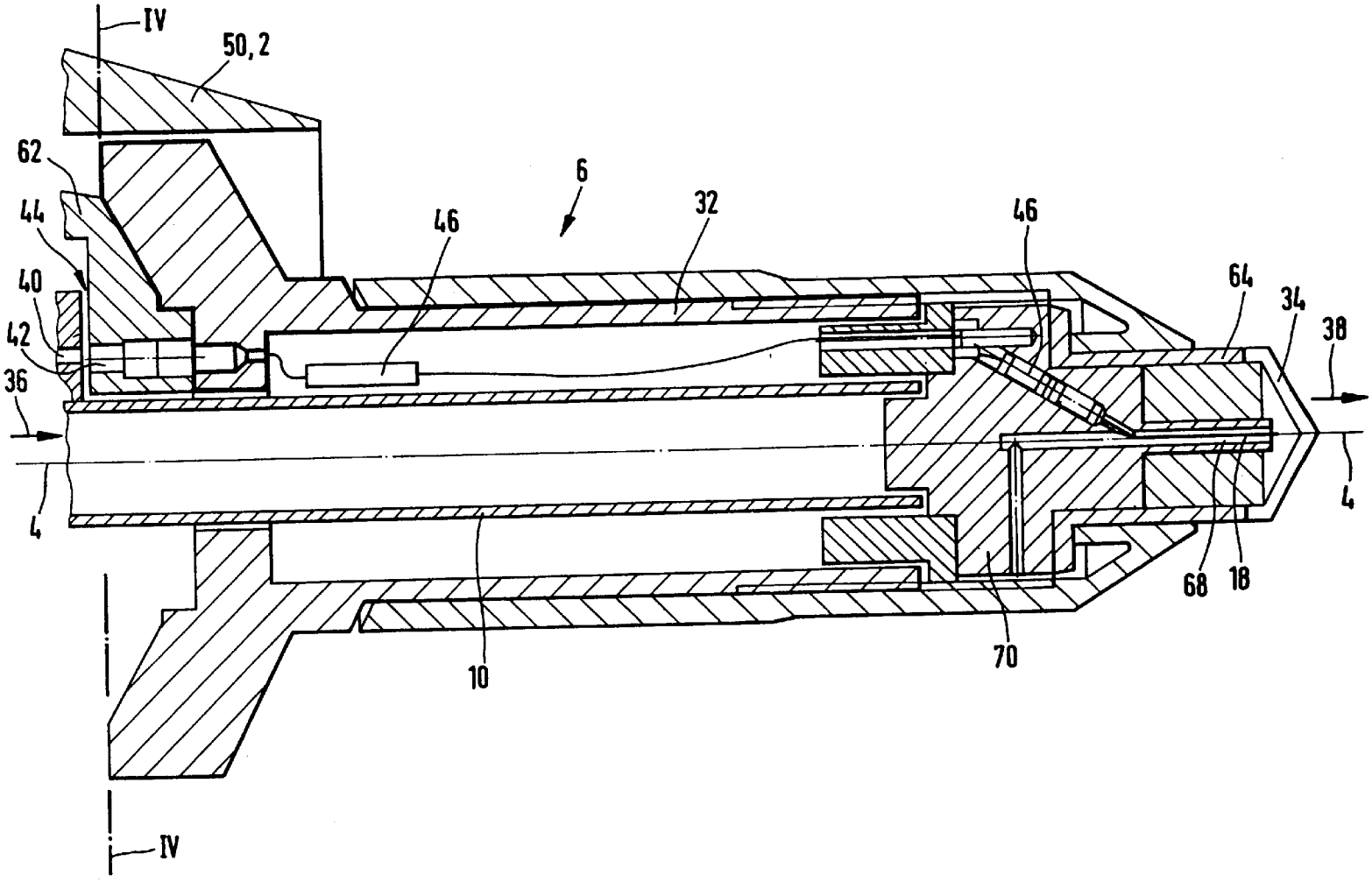
FIG. 4B is a fragmentary view in axial cross section of a front portion of the spray coating apparatus of FIG. 4A, with the portions of FIGS. 4A and 4B joining at the cross sectional plane IV—IV.

FIGS. 4A and 4B show a further embodiment of spray apparatus according to the invention. The operating principals are the same as in the embodiment of FIGS. 1 and 2. In the embodiment according to FIGS. 4A and 4B, the housing 8 has a sleeve 50 that extends forward from a rear end to surrounds the turbine wheel 28. A narrow annular gap 52 is formed between a rear end of the nozzle 32 and the sleeve 50. The sleeve 50 and the gap 52 cause at least a part 53 of the turbine exhaust air to flow forwardly over the nozzle 32, blowing powder particles away from the nozzle 32. Another portion 55 of the turbine exhaust air can escape through bores 54 that are formed in the sleeve 50 around the turbine blades 26. Replaceable flow restrictors 56 can be screwed into the bores 54. The restrictors 56 may be provided with different size vent openings. By selecting restrictors 56 with different size vent openings, the quantitative parts 53 and 55 of the turbine exhaust air can be adjusted to control the flow velocity of the turbine exhaust air and thus to a limited extent also to adjust the speed of rotation of the turbine wheel 28. The turbine speed also may be adjusted by adjusting the compressed air flow which drives the turbine or through the use of a brake.

In the embodiment of FIGS. 4A and 4B, the rotary assembly 6 is mounted to rotate on a tubular hub 57 through the intermediary of two axially spaced anti-friction bearings 58 and 60. The bearings 58 and 60 may be, for example, ball bearings, roller bearings, sleeve bearings or air bearings. The hub 57 is stationary relative to the housing 8 and thus is stationary relative to the powder duct or tube 10. The tubular hub 57 is arranged concentrically to the axis of rotation 4.

A hollow hub assembly 62 is located on a rear end of the rotary assembly 6. The hub assembly 62 surrounds the hub 57 and is joined to it by the anti-friction bearings 58 and 60. The hub assembly 62 supports the nozzle 32. The nozzle 32 has an exchangeable nozzle element 33 in which the slot shaped spray aperture 34 is formed. Different nozzle elements may be provided with different size and different shaped apertures 34 for use with different coating materials and for different coating applications.

One or several electric resistors 46 are shown arranged in the rotating nozzle 32, while a high voltage electrode 18 is arranged axially on the axis of rotation 4 immediately upstream from the spray aperture 34. Alternately, the resistor (s) 46 can be accommodated in the non rotating main body assembly 2 instead of in the rotating spray nozzle 32. The high voltage electrode 18 extends through an electrode air duct 68 and an electrode holder 70 which is generally in the form of a thin plate. The plate shaped electrode holder 70 is disposed on the axis of rotation 4 in the powder flow path. Thus, the powder will flow past the sides of the electrode 18.

In all embodiments of the invention, the rotary assembly 6 is separable from the non rotating main body assembly 2. The individual elements forming the main body assembly 2 and forming the rotary assembly 6 also can be disassembled so that they may be cleaned or replaced by other components in order to achieve different spray characteristics.

The speed of rotation of the spray nozzle 32 may range between 120 rpm and 6,000 rpm. These rotational speeds are considerably lower than the speeds of rotation of known rotary atomizer bells where the coating fluid is atomized only by rotation. Rotary atomizer bells typically operate at rotational speeds ranging between 2,000 rpm and 12,000 rpm.

Rotation of the nozzle element 33 may be retarded during coating in order for the spray stream to better penetrate into folds or cavities in the article being coated. The rotational speed may be retarded or braked, for example, by controlling or reversing the turbine air flow or by a braking device. For example, a hose 72 may be expanded by compressed air until it is squeezed between a non rotating part of the main body assembly 2 and a part which rotates with the nozzle element 33. An annular hose 72 is illustrated in FIG. 4A as being disposed between the hub 57 and the sleeve 50.

As a consequence of the rotation of the nozzle element 33 and its spray aperture 34, the powder spirals about the electrode 18. The spiral flow lengthens the path which the powder must travel within the charging zone of the electrode 18 as compared to a stationary nozzle. As a result, the electrostatic charging of the powder is much better then in prior art spray apparatus with stationary nozzle assemblies. The improved powder charging in turn increases the coating efficiency.

It will be appreciated that various modifications and changes may be made to the above described preferred embodiment of without departing from the scope of the following claims.

I claim:

1. In an electrostatic powder coating apparatus for spraying of powder coating material onto an article being coated, said apparatus having a body, a nozzle which is connected to said body and has a spray orifice for spraying the powder coating material, at least one high voltage electrode adapted for the electrostatic charging of the coating material, and a coating material duct extending through said body to said spray orifice in said nozzle, the improvement comprising means mounting said nozzle to rotate relative to said body about an axis of rotation which extends in a main spraying direction of the spray orifice, drive means adapted to rotate said nozzle about said axis of rotation during spraying, and wherein the spray orifice is in the form of an elongated slot which extends perpendicular to said axis of rotation.

2. Electrostatic coating apparatus, as set forth in claim 1, and wherein said high voltage electrode is mounted to rotate together with said nozzle, wherein a high voltage path extends from said body as far as said high voltage electrode, and wherein a high voltage path has a non rotating high voltage path section in said body and a section rotatable relative to said body with said nozzle.

3. Electrostatic coating apparatus, as set forth in claim 2, and wherein the high voltage path includes a narrow air gap formed between the non rotatable path section and the rotatable path section, and wherein said path sections are electrically connected to one another by the air in said air gap.

4. Electrostatic coating apparatus, as set forth in claim 3, and wherein said drive means comprises a compressed air driven turbine.

5. Electrostatic coating apparatus, as set forth in claim 4, and further including means adapted for braking rotation of said nozzle relative to said body.

6. Electrostatic coating apparatus, as set forth in claim 1, and wherein said drive means comprises a compressed air driven turbine.

7. Electrostatic coating apparatus, as set forth in claim 1, and further including means adapted for braking rotation of said nozzle relative to said body.

8. Electrostatic coating apparatus, as set forth in claim 1, and further including means for controlling the speed that said nozzle is rotated.

9. Electrostatic coating apparatus, as set forth in claim 1, and wherein said elongated slot has a rectangular shape and wherein said axis of rotation passes through a center of said slot.

10. A method for electrostatic powder coating by spraying with a fluidized powder coating material using apparatus having a body, a nozzle which is connected to said body and has a spray orifice for spraying the fluidized powder coating material, at least one high voltage electrode adapted for the electrostatic charging of the fluidized powder coating material, and a fluidized powder coating material duct extending through said body to said spray orifice in said nozzle, said method comprising the steps of:

a) forming said orifice in said nozzle to have an elongated slot shape;

b) mounting said nozzle to rotate relative to said body about an axis of rotation which extends in a main spraying direction of the spray orifice with said slot shaped orifice extending perpendicular to said axis of rotation;

c) driving said nozzle to rotate about said axis of rotation while spraying powder coating material from said nozzle.

* * * * *